US005168004A

United States Patent [19]

Daumit et al.

[11] Patent Number: 5,168,004

[45] Date of Patent: * Dec. 1, 1992

[54] MELT-SPUN ACRYLIC FIBERS POSSESSING A HIGHLY UNIFORM INTERNAL STRUCTURE WHICH ARE PARTICULARLY SUITED FOR THERMAL CONVERSION TO QUALITY CARBON FIBERS

[75] Inventors: Gene P. Daumit; Yoon S. Ko; Christopher R. Slater, all of Charlotte; Jozef G. Venner, Matthews; Chi C. Young, Charlotte, all of N.C.

[73] Assignee: BASF Aktiengesellschaft, Ludwigshafen, Fed. Rep. of Germany

[ * ] Notice: The portion of the term of this patent subsequent to Jan. 1, 2008 has been disclaimed.

[21] Appl. No.: 498,693

[22] Filed: Mar. 26, 1990

Related U.S. Application Data

[62] Division of Ser. No. 236,186, Aug. 25, 1988, Pat. No. 4,935,180.

[51] Int. Cl.[5] ..... B32B 9/00

[52] U.S. Cl. ..... 428/221; 423/447.1; 423/447.2; 428/296; 428/364; 428/367; 428/397; 428/408

[58] Field of Search ..... 428/364, 367, 221, 296, 428/397, 408; 423/447.1, 447.2

[56] References Cited

U.S. PATENT DOCUMENTS

| | | | |
|---|---|---|---|
| 2,679,492 | 5/1954 | Hampson et al. | 524/259 |
| 2,858,444 | 2/1952 | Coxe | 264/182 |
| 2,914,376 | 11/1959 | Bibolet et al. | 264/182 |
| 3,078,243 | 2/1963 | Bibolet et al. | 524/209 |
| 3,634,575 | 1/1966 | Serad | 264/210.8 |
| 3,655,857 | 10/1968 | Bohrer et al. | 264/206 |

(List continued on next page.)

FOREIGN PATENT DOCUMENTS 62-062909 3/1987 Japan .

OTHER PUBLICATIONS

"Fiber Forming from a Hydrated Melt-Is it a Turn for the Better in Pan Fibre Forming Technology Chemical Fibers", Mar. 1986, pp. 39-56, by Edward Maslowski.

(List continued on next page.)

*Primary Examiner*—Lorraine T. Kendell

*Attorney, Agent, or Firm*—Burns, Doane, Swecker & Mathis

[57] ABSTRACT

An acrylic multifilamentary material possessing an internal structure which is particularly suited for thermal conversion to high strength carbon fibers is formed via a specifically defined combination of processing conditions. The acrylic polymer while in substantially homogeneous admixture with appropriate concentrations (as defined) of acetonitrile and water is melt extruded and is drawn at a relatively low draw ratio which is substantially less than the maximum draw ratio achievable. This fibrous material which is capable of readily undergoing drawing is passed through a heat treatment zone wherein the evolution of residual acetonitrile and water takes place. The resulting fibrous material following such heat treatment is subjected to additional drawing to accomplish further orientation and internal structure modification and to produce a fibrous material of the appropriate denier for carbon fiber production. One accordingly is provided a reliable route to form a fibrous acrylic precursor for carbon fiber production without the necessity to employ the solution-spinning routes commonly utilized in the prior art for precursor formation. One can now eliminate the utilization and handling of large amounts of solvent as has heretofore been necessary when forming an acrylic carbon fiber precursor. Also, acrylic fiber precursors possessing a wide varity of cross-sectional configurations and a highly uniform internal structure now are made possible which can be thermally converted into carbon fibers of a similar cross-sectional configuration which are substantially void free when examined in cross secton at a magnification of 2,000×.

17 Claims, 3 Drawing Sheets

U.S. PATENT DOCUMENTS

| | | | |
|---|---|---|---|
| 3,669,919 | 6/1972 | Champ | 524/205 |
| 3,702,054 | 11/1972 | Araki et al. | 423/447.4 X |
| 3,838,562 | 10/1974 | Park | 57/243 |
| 3,873,508 | 3/1975 | Turner | 526/86 |
| 3,896,204 | 7/1975 | Goodman et al. | 264/206 |
| 3,940,405 | 2/1976 | Serad | 523/324 |
| 3,984,601 | 10/1976 | Blickenstaff | 428/364 |
| 4,094,948 | 6/1978 | Blickenstaff | 264/206 |
| 4,108,818 | 8/1978 | Odawara et al. | 524/205 |
| 4,163,770 | 8/1979 | Porosoff | 264/210.3 |
| 4,205,039 | 5/1980 | Streetman et al. | 264/206 |
| 4,219,523 | 8/1980 | Porosoff | 264/206 |
| 4,220,616 | 9/1980 | Pfeiffer et al. | 264/206 |
| 4,220,617 | 9/1980 | Pfeiffer et al. | 264/206 |
| 4,238,442 | 12/1980 | Cline et al. | 264/206 |
| 4,254,076 | 3/1981 | Pfeiffer et al. | 264/206 |
| 4,261,945 | 4/1981 | Pfeiffer et al. | 264/171 |
| 4,276,011 | 6/1981 | Siegman et al. | 425/198 |
| 4,278,415 | 7/1981 | Pfeiffer | 425/466 |
| 4,283,365 | 8/1981 | Young et al. | 264/206 |
| 4,301,104 | 11/1981 | Streetman et al. | 264/168 |
| 4,301,107 | 11/1981 | Kreahling et al. | 264/206 |
| 4,303,607 | 12/1981 | DeMaria et al. | 264/178 |
| 4,316,714 | 2/1982 | Pfeiffer et al. | 425/382 |
| 4,317,790 | 3/1982 | Siegman et al. | 264/776 |
| 4,318,680 | 3/1982 | Pfeiffer et al. | 425/382 |
| 4,346,053 | 8/1982 | Pfeiffer | 264/561 |
| 4,394,339 | 7/1983 | Pfeiffer et al. | 264/177 |
| 4,418,176 | 11/1983 | Streetman et al. | 525/57 |
| 4,461,739 | 7/1984 | Young et al. | 264/176 |
| 4,524,105 | 6/1985 | Streetman et al. | 428/364 |
| 4,534,919 | 8/1985 | McAliley et al. | 264/29.2 |
| 4,628,001 | 12/1986 | Sasaki et al. | 428/367 |
| 4,714,642 | 12/1987 | McAliley et al. | 428/113 |

OTHER PUBLICATIONS

Part II-Evaluation of the Properties of Carbon Fibers Produced from Melt-Spun Polyacryloitrile-Based Fibers by Dale A. Grove, Georgia Institute of Technology, 1986, pp. 97-167.

"Final Report on High-Performance Fibers II, An International Evaluation to Group Member Companies" by Donald C. Slivka et al., 1987 Battelle, Columbus Division, pp. 182-184.

High Tech-The Way into the Nineties, "A unique Approach to Carbon Fibers Precursor Development" by Gene P. Daumit and Yoon S. Ko, 1986 pp. 201-213.

"Exploratory Experiments in the Conversion of Plasticized Melt Spun PAN-Based Precursors to Carbon Fibers" by Dale Grove, P. Desai and A. S. Abrihaman, Carbon, vol. 26, No. 3, pp. 403-411, 1988.

MELT-SPUN ACRYLIC FIBERS POSSESSING A HIGHLY UNIFORM INTERNAL STRUCTURE WHICH ARE PARTICULARLY SUITED FOR THERMAL CONVERSION TO QUALITY CARBON FIBERS

This application is a divisional, of application Ser. No. 236,186, filed Aug. 25, 1988 now U.S. Pat. No. 4,935,180.

BACKGROUND OF THE INVENTION

Carbon fibers are being increasingly used as fibrous reinforcement in a variety of matrices to form strong lightweight composite articles. Such carbon fibers are formed in accordance with known techniques by the thermal processing of previously formed precursor fibers which commonly are acrylic polymer fibers or pitch fibers. Heretofore, the formation of the fibrous precursor has added significantly to the cost of the carbon fiber production and often represents one of the greatest costs associated with the manufacture of carbon fibers.

All known commercial production of acrylic precursor fibers today is based on either dry- or wet-spinning technology. In each instance the acrylic polymer commonly is dissolved in an organic or inorganic solvent at a relatively low concentration which typically is 5 to 20 percent by weight and the fiber is formed when the polymer solution is extruded through spinnerette holes into a hot gaseous environment (dry spinning) or into a coagulating liquid (wet spinning). Acrylic precursor fibers of good quality for carbon fiber production can be formed by such solution spinning; however, the costs associated with the construction and operation of this fiber-forming route are expensive. See, for instance, U.S. Pat. No. 4,069,297 wherein acrylic fibers are formed by wet spinning wherein the as-spun fibers are coagulated with shrinkage, washed while being stretched, dried, and stretched prior to being used as a precursor for carbon fiber production. A key factor is the requirement for relatively large amounts of solvents, such as aqueous sodium thiocyanate, ethylene carbonate, dimethylformamide, dimethylsulfoxide, aqueous zinc chloride, etc. The solvents often are expensive, and further require significant capital requirements for facilities to recover and handle the same. Precursor fiber production throughputs for a given production facility tend to be low in view of the relatively high solvent requirements. Finally, such solution spinning generally offers little or no control over the cross-sectional configurations of the resulting fibers. For instance, wet spinning involving inorganic solvents generally yields substantially circular fibers, and wet spinning involving organic solvents often yields irregular oval or relatively thick "kidney bean" shaped fibers. Dry spinning with organic solvents generally yields fibers having an irregularly shaped "dog-bone" configuration.

It is recognized that acrylic polymers possess pendant nitrile groups which are partially intermolecularly coupled. These groups greatly influence the properties of the resulting polymer. When such acrylic polymers are heated, the nitrile groups tend to crosslink or cyclize via an exothermic chemical reaction. Although the melting point of a dry (non-hydrated) acrylonitrile homopolymer is estimated to be 320° C., the polymer will undergo significant cyclization and thermal degradation before a melt phase is ever achieved. It further is recognized that the melting point and the melting energy of an acrylic polymer can be decreased by decoupling nitrile-nitrile association through the hydration of pendant nitrile groups. Water can be used as the hydrating agent. Accordingly, with sufficient hydration and decoupling of nitrile groups, the melting point of the acrylic polymer can be lowered to the extent that the polymer can be melted without a significant degradation problem, thus providing a basis for its melt spinning to form fibers.

While not a commercial reality, a number of processes involving the hydration of nitrile groups have been proposed in the technical literature for the melt spinning of acrylic fibers. Such acrylic melt-spinning proposals generally have been directed to the formation of fibers for ordinary textile applications wherein less demanding criteria for acceptability usually are operable. The resulting fibers have tended to lack the uniform structure coupled with the correct denier per filament required for quality carbon fiber production. For instance, the required uniform molecular orientation commonly is absent, surface defects and significant numbers of broken filaments are present, and/or an unacceptably high level of large voids or other flaws are present within the fiber interior. Even though "substantially void free" terminology has been utilized in some of the technical literature of the prior art with respect to the resulting acrylic fibers, satisfactory carbon fibers could not be formed from the same.

Representative, prior disclosures which concern the melt or similar spinning of an acrylic polymer to form acrylic fibers primarily intended for the usual textile applications include: U.S. Pat. Nos. 2,585,444 (Coxe); 3,655,857 (Bohrer et al); 3,669,919 (Champ); 3,838,562 (Park); 3,873,508 (Turner); 3,896,204 (Goodman et al); 3,984,601 (Blickenstaff); 4,094,948 (Blickenstaff); 4,108,818 (Odawara et al); 4,163,770 (Porosoff); 4,205,039 (Streetman et al); 4,418,176 (Streetman et al); 4,219,523 (Porosoff); 4,238,442 (Cline et al); 4,283,365 (Young et al); 4,301,104 (Streetman et al); 4,303,607 (DeMaria et al); 4,461,739 (Young et al); and 4,524,105 (Streetman et al). Representative prior spinnerette disclosures for the formation of acrylic fibers from the melt include: U.S. Pat. Nos. 4,220,616 (Pfeiffer et al); 4,220,617 (Pfeiffer et al); 4,254,076 (Pfeiffer et al); 4,261,945 (Pfeiffer et al); 4,276,011 (Siegman et al); 4,278,415 (Pfeiffer); 4,316,714 (Pfeiffer et al); 4,317,790 (Siegman et al); 4,318,680 (Pfeiffer et al); 4,346,053 (Pfeiffer et al); and 4,394,339 (Pfeiffer et al).

Heretofore, acrylic fiber melt-spinning technology has not been sufficiently advanced to form acrylic fibers which are well suited for use as precursors for carbon fibers. However, suggestions for the use of melt spinning to form acrylic fibers intended for use as carbon fiber precursors can be found in the technical literature. See, for instance, the above-identified U.S. Pat. No. 3,655,857 (Bohrer et al); "Fiber Forming From a Hydrated Melt—Is It a Turn for the Better in PAN Fiber Forming Technology?", Edward Maslowski, Chemical Fibers, pages 36 to 56 (March, 1986); Part II—Evaluation of the Properties of Carbon Fibers Produced From Melt-Spun Polyacrylonitrile-Based Fibers, Master's Thesis, Dale A. Grove, Georgia Institute of Technology, pages 97 to 167 (1986); High Tech-the Way into the Nineties, "A Unique Approach to Carbon Fiber Precursor Development," Gene P. Daumit and Yoon S. Ko, pages 201 to 213, Elsevier Science Publishers, B.V., Amsterdam (1986); Japanese Laid-Open Patent Application No. 62-062909 (1987); and "Final Report on High-Performance Fibers II, An International Evaluation to Group Member Companies," Donald C. Slivka, Thomas R. Steadman and Vivian Bachman, pages 182 to 184, Battelle Columbus Division (1987); and "Exploratory Experiments in the Conversion of Plasticized Melt Spun PAN-Based Precursors to Carbon Fibers", Dale Grove, P. Desai, and A.S. Abhiraman, *Carbon.* Vol 26, No. 3, pages 403 to 411 (1988). The Daumit and Ko article identified above was written by two of the present joint-inventors and contains a non-enabling disclosure with respect to the presently claimed invention.

In our copending U.S. Ser. No. 236,177, filed Aug. 25, 1988 (now U.S. Pat. No. 4,921,656), entitled "Improvements in the Formation of Melt-Spun Acrylic Fibers Which Are Particularly Suited for Thermal Conversion to High Strength Carbon Fibers" is disclosed a companion invention wherein the as-spun acrylic fiber product may be used to form carbon fibers of high strength. The products of the present invention tend to possess greater internal perfection than those of such companion application.

It is an object of the present invention to provide an improved process for the melt spinning of acrylic fibers which are particularly suited for carbon fiber production in the substantial absence of filament breakage.

It is an object of the present invention to provide an improved process for the melt spinning of acrylic fibers which possess an internal structure which is particularly well suited for subsequent thermal conversion to form quality carbon fibers.

It is an object of the present invention to provide an improved process for the melt spinning of acrylic fibers which possess an internal structure which is particularly well suited for subsequent thermal conversion to form quality carbon fibers having a relatively low denier per filament.

It is an object of the present invention to provide an improved process for the melt spinning of acrylic fibers which possess an internal structure which is particularly well suited for subsequent thermal conversion to form quality carbon fibers of a predetermined substantially uniform cross-sectional configuration which may be widely varied.

It is an object of the present invention to provide an improved process for melt spinning of acrylic fibers which are particularly suited for carbon fiber production wherein such acrylic fiber precursor formation is capable of being expeditiously carried out on a relatively economical basis.

It is an object of the present invention to provide an improved process for the formation of acrylic fibers which are particularly well suited for carbon fiber production wherein such spinning is carried out using a lesser concentration of solvents than was used in the prior art.

It is an object of the present invention to provide an improved process for the formation of acrylic fibers which are particularly suited for carbon fiber production requiring lesser capital requirements to implement than the prior art and being capable of operation on an expanded scale through the use of readily manageable increments of equipment.

It is another object of the present invention to provide novel acrylic fibers which are substantially void free when examined in cross section at a magnification of 2,000× and thereby possess a highly uniform internal structure which is particularly well suited for thermal conversion to carbon fibers.

It is a further object of the present invention to provide novel carbon fibers of good quality which are substantially void free when examined in cross section at a magnification of 2,000× having a predetermined substantially uniform cross-sectional configuration formed by the thermal processing of the improved melt-spun acrylic fibers of the present invention.

These and other objects as well as the scope, nature, and utilization of the claimed invention will be apparent to those skilled in the art from the following detailed description and appended claims.

SUMMARY OF THE INVENTION

It has been found that an improved process for the formation of an acrylic multifilamentary material possessing a highly uniform internal structure which is particularly suited for thermal conversion to quality carbon fibers comprises:

(a) forming at an elevated temperature a substantially homogeneous melt consisting essentially of (i) an acrylic polymer containing at least 85 weight percent (preferably at least 91 weight percent) of recurring acrylonitrile units, (ii) approximately 11 to 25 percent by weight (preferably 14 to 21 percent by weight) of acetonitrile based upon the polymer, and (iii) approximately 12 to 28 percent b weight (preferably 15 to 23 percent by weight) of water based upon the polymer, (b) extruding the substantially homogeneous melt while at a temperature within the range of approximately 140° to 190° C. (preferably 155° to 185° C.) which exceeds the hydration and melting temperature by at least 15° C. through an extrusion orifice containing a plurality of openings into a filament-forming zone provided with a substantially non-reactive gaseous atmosphere (preferably of air, steam, carbon dioxide, nitrogen, and mixtures thereof) provided at a temperature within the range of approximately 25° to 250° C. (preferably within the range of 90° to 200° C.) while under a longitudinal tension wherein substantial portions of the acetonitrile and water are evolved and an acrylic multifilamentary material is formed, (c) drawing the substantially homogeneous melt and acrylic multifilamentary material subsequent to passage through the extrusion orifice at a draw ratio of approximately 0.6 to 6.0:1 (preferably 0.8 to 5.0:1), (d) passing the resulting acrylic multifilamentary material following steps (b) and (c) in the direction of its length through a heat treatment zone provided at a temperature of approximately 90° to 200° C. (preferably 110° to 175° C.) while at a relatively constant length wherein the evolution of substantially all of the residual acetonitrile and water present therein takes place, and (e) drawing the acrylic multifilamentary material resulting from step (d) while at an elevated temperature at a draw ratio of at least 3:1 multifilamentary material having a mean single filament denier of approximately 0.3 to 5.0 (preferably 0.5 to 2.0).

Novel acrylic fibers which possess an internal structure which is highly uniform and particularly well suited for thermal conversion to carbon fibers are provided. Also, novel quality carbon fibers having a predetermined cross-sectional configuration formed by the thermal processing of the improved melt-spun acrylic fibers of the present invention are provided.

Figure 2:
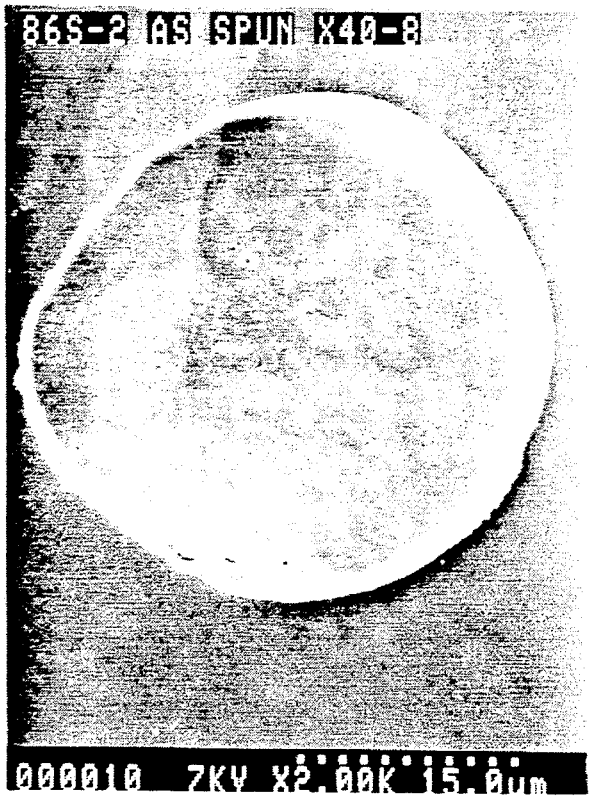
FIG. 2 is a photograph of a cross section of a representative substantially circular as-spun acrylic fiber formed in accordance with the process of the present invention immediately prior to the heat treatment step at a magnification of 2,000× obtained by the use of a scanning electron microscope. This photograph illustrates the absence of a discrete outer sheath, and a highly uniform internal structure. Any voids which are visible measure less than 0.2 micron.
Figure 3:
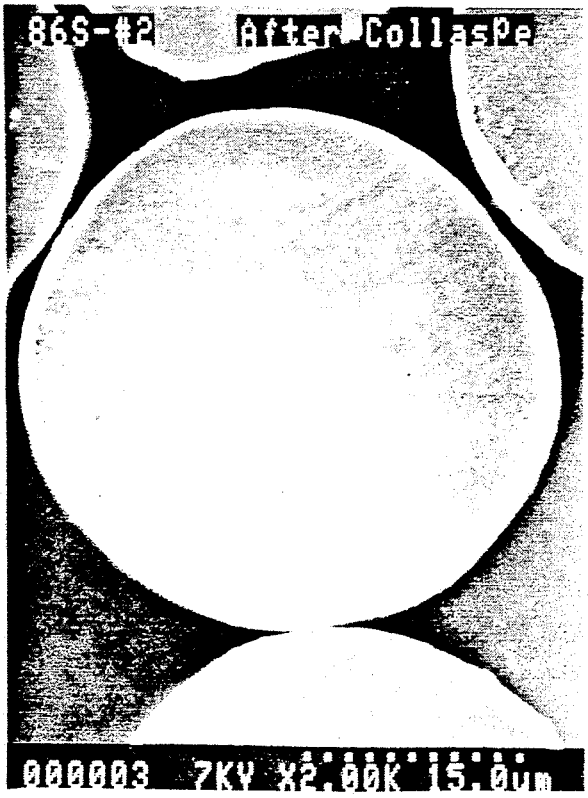
FIG. 3 is a photograph of a cross section of a representative substantially circular acrylic fiber obtained at the conclusion of the heat treatment step of the process of the present invention at a magnification of 2,000× obtained by the use of a scanning electron microscope. This photograph illustrates the absence of a discrete outer sheath, and a further enhancement of the uniformity of the internal structure. The light markings appearing on the face of the cross section are artifacts produced during the filament cutting operation.
Figure 4:
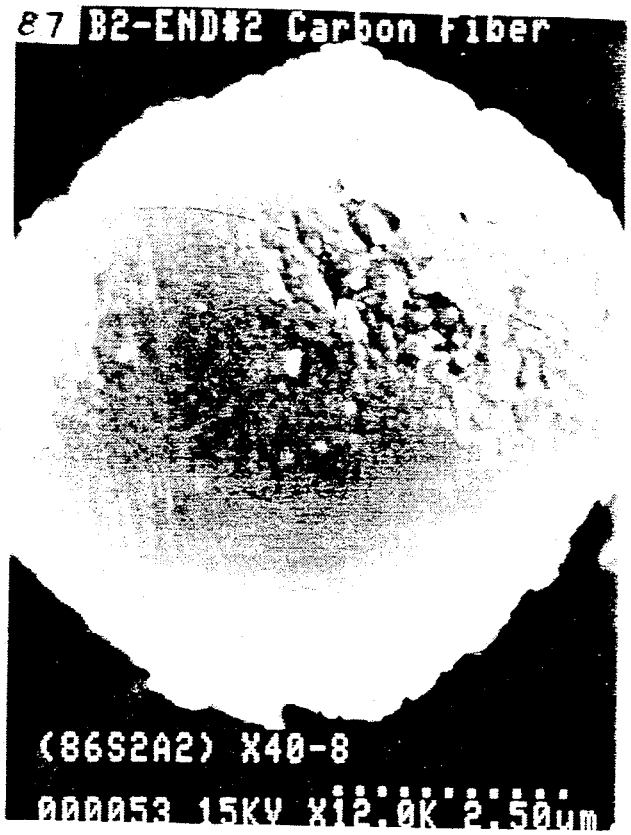
FIG. 4 is a photograph of a cross section of a representative substantially circular carbon fiber formed by the thermal processing of a representative substantially circular acrylic fiber of the present invention at a magnification of 12,000× obtained by the use of a scanning electron microscope. Any voids which are visible measure less than 0.1 micron.

When preparing the cross sections of FIGS. 2 and 3, the filaments were embedded in paraffin wax and slices having a thickness of 2 microns were cut using an ultramicrotome. The wax was dissolved using three washes with xylene, a single wash with ethanol, the cross sections were washed with distilled water, dried, and were sputtered with a thin gold coating prior to examination under a scanning electron microscope. When preparing the cross sections of FIGS. 4 and 5, the carbon fibers were coated with silver paint, were cut with a razor blade adjacent to the area which was coated with silver paint, and were sputtered with a thin gold coating prior to examination under a scanning electron microscope.

DESCRIPTION OF PREFERRED EMBODIMENTS

The acrylic polymer which is selected for use as the starting material of the present invention contains at least 85 weight percent of recurring acrylonitrile units and may be either an acrylonitrile homopolymer or an acrylonitrile copolymer which contains up to about 15 weight percent of one or more monovinyl units. Terpolymers, etc. are included within the definition of copolymer. Representative monovinyl units which may be copolymerized with the recurring acrylonitrile units include methyl acrylate, methacrylic acid, styrene, methyl methacrylate, vinyl acetate, vinyl chloride, vinylidene chloride, vinyl pyridine, itaconic acid, etc. The preferred comonomers are methyl acrylate, methyl methacrylate, methacrylic acid, and itaconic acid.

In a preferred embodiment the acrylic polymer contains at least 91 weight percent (e.g., 91 to 98 weight percent) of recurring acrylonitrile units. A particularly preferred acrylic polymer comprises 93 to 98 weight percent of recurring acrylonitrile units, approximately 1.7 to 6.5 weight percent of recurring units derived from methyl acrylate and/or methyl methacrylate, and approximately 0.3 to 2.0 weight percent of recurring units derived from methacrylic acid and/or itaconic acid.

The acrylic polymer which is selected as the starting material preferably is formed by aqueous suspension polymerization and commonly possesses an intrinsic viscosity of approximately 1.0 to 2.0, and preferably 1.2 to 1.6. Also, the acrylic polymer preferably possesses a kinematic viscosity (Mk) of approximately 43,000 to 69,000, and most preferably 49,000 to 59,000. The polymer conveniently may be washed and dried to the desired water content in a centrifuge or other suitable equipment.

In a preferred embodiment the acrylic polymer starting material is blended with a minor concentration of a lubricant and a minor concentration of a surfactant. Each of these components advantageously may be provided in a concentration of approximately 0.05 to 0.5 percent by weight (e.g. 0.1 to 0.3 percent by weight) based upon the dry weight of the acrylic polymer. Representative lubricants include: sodium stearate, zinc stearate, stearic acid, butylstearate, other inorganic salts and esters of stearic acid, etc. The preferred lubricant is sodium stearate. The lubricant when present in an effective concentration aids the process of the present invention by lowering the viscosity of the melt and serving as an external lubricant. Representative surfactants include: sorbitan monolaurate, sorbitan monopalmitate, sorbitan monostearate, sorbitan tristearate, sorbitan monooleate, sorbitan sesquioleate, sorbitan tioleate, etc. The preferred surfactant is a nonionic long chain fatty acid containing ester groups which is sold as sorbitan monolaurate by Emery Industries, Inc. under the EMSORB trademark. The surfactant when present in an effective concentration aids the process of the present invention by enhancing in the distribution of the water component in the composition which is melt extruded (as described hereafter). The lubricant and surfactant initially may be added to the solid particulate acrylic polymer with water while present in a blender or other suitable mixing device.

The acrylic polymer prior to melt extrusion is provided at an elevated temperature as a substantially homogeneous melt which contains approximately 11 to 25 percent by weight (preferably approximately 14 to 21 percent by weight) of acetonitrile based upon the polymer, and approximately 12 to 28 percent by weight (preferably approximately 15 to 23 percent by weight) of water based upon the polymer. The higher water concentrations tend to be used with the acrylic polymers having the higher acrylonitrile contents.

The use of organic materials other than acetonitrile commonly has been found to depress carbon fiber properties, impart higher levels of voidiness to the fibrous product, preclude the possibility of drawing to a sufficiently low denier to serve as a precursor for carbon fiber production, or to require unreasonably long wash times to remove the same from the resulting as-spun fibers. For instance, materials such as methanol alone, dimethylsulfoxide, acetone alone, and methylethylketone, have been found to significantly increase voidiness. High boiling acrylic solvents such as ethylene carbonate and sodium thiocyanate have been found to produce a substantially void-free product; however, such solvents are difficult to remove from the resulting fibers and when present reduce the mechanical properties of any carbon fibers formed from the same. Minor amounts (e.g., less than approximately 2 percent by weight of the polymer) of other solvents (e.g. acetone, etc.) optionally may be included in the melt employed in the present process so long as they do not interfere with the formation of a substantially homogeneous melt, can be satisfactorily removed during the heat treatment step described hereafter and do not substantially interfere with the advantageous results reported herein.

The substantially homogeneous melt is formed by any convenient technique and commonly assumes the appearance of a transparent thick viscous liquid. Particularly good results have been achieved by initially forming pellets which include the acrylic polymer, acetonitrile, and water in the appropriate concentrations. These pellets subsequently may be fed to a heated extruder (e.g., single screw, double screw, etc.) where the components of the melt become well admixed prior to melt extrusion. In a preferred embodiment, the homogeneous melt contains approximately 72 to 80 (e.g. 74 to 80) percent by weight of the acrylic polymer based upon the total weight of the melt.

It has been found that the acrylic polymer in association with the acetonitrile and water (as described) commonly hydrates and melts at a temperature of approximately 110° to 150° C. Such hydration and melting temperature has been found to be dependent upon the specific acrylic polymer and the concentrations of acetonitrile and water present and can be determined for each composition. The acetonitrile which is present with the acrylic polymer in the specified concentration will advantageously influence to a significant degree the temperature at which the acrylic polymer hydrates and melts. Accordingly, in accordance with the present invention, the acrylic polymer melting temperature is significantly reduced and one now is able to employ a melt extrusion temperature which substantially exceeds the polymer hydration and melting temperature without producing any significant polymer degradation. The temperature of hydration and melting for a given system conveniently may be determined by placing the components in a sealed glass ampule having a capacity of 40 ml. and a wall thickness of 5 mm. which is at least one-half filled and carefully observing the same for initial melting while heated in an oil bath of controlled uniform temperature while the temperature is raised at a rate of 5° C./30 minutes. The components which constitute the substantially homogeneous melt commonly are provided at a temperature of approximately 140° to 190° C. (most preferably approximately 155° to 185° C.) at the time of melt extrusion. In a preferred embodiment the melt extrusion temperature exceeds the hydration and melting temperature by at least 15° C., and most preferably by at least 20° C. (e.g., 20 to 40° C.). Such temperature maintenance above the hydration and melting temperature has been found to result in a significant reduction in the viscosity of the melt and permits the formation of an as-spun fiber having the desired denier per filament. It has been found that significant acrylic polymer degradation tends to take place at a temperature much above 190° C. Accordingly, such temperatures are avoided for best results.

The equipment utilized to carry out the melt extrusion of the substantially homogeneous melt to form an acrylic multifilamentary material may be that which is commonly utilized for the melt extrusion of conventionally melt-spun polymers. Standard extrusion mixing sections, pumps, and filters may be utilized. The extrusion orifices of the spinnerette contain a plurality of orifices which commonly number from approximately 500 to 50,000 (preferably 1,000 to 24,000).

The process of the present invention unlike solution-spinning processes provides the ability to form on a reliable basis acrylic fibers having a wide variety predetermined substantially uniform cross-sectional configurations. For instance, in addition to substantially circular cross sections, predetermined substantially uniform non-circular cross sections may be formed. Representative non-circular cross sections are crescent-shaped (i.e., C-shaped), square, rectangular, multi-lobed (e.g., 3 to 6 lobes), etc. When forming substantially circular fibers, the circular openings of the spinnerette commonly are approximately 40 to 65 microns in diameter. Extrusion pressures of approximately 100 to 10,000 psi commonly are utilized at the time of melt extrusion.

Once the substantially homogeneous melt exits the extrusion orifice, it passes into a filament-forming zone provided with a substantially non-reactive gaseous atmosphere provided at a temperature of approximately 25° to 250° C. (preferably approximately 90° to 200° C.) while under a longitudinal tension. Representative substantially non-reactive gaseous atmospheres for use in the filament-forming zone include: air, steam, carbon dioxide, nitrogen, and mixtures of these. Air and steam atmospheres are preferred. The substantially non-reactive atmosphere commonly is provided in the filament-forming zone at a pressure of approximately 0 to 100 psig (preferably at a superatmospheric pressure of 10 to 50 psig).

A substantial portion of the acetonitrile and water present in the melt at the time of extrusion is evolved in the filament-forming zone. Some acetonitrile and water will be present in the gaseous phase in the filament-forming zone. The non-reactive gaseous atmosphere present in the filament-forming zone preferably is purged so as to remove in a controlled manner materials which are evolved as the melt is transformed into a solid multifilamentary material. When the as-spun multifilamentary material exits the filament-forming zone, it preferably contains no more than 6 percent by weight (most preferably no more than 4 percent) of acetonitrile based upon the polymer.

Subsequent to its passage through the spinnerette in accordance with the concept of the present invention the substantially homogeneous melt and resulting acrylic multifilamentary material are drawn at a relatively low draw ratio which is substantially less than the maximum draw ratio achievable for such material. For instance, the draw ratio utilized is approximately 0.6 to 6.0:1 (preferably 1.2 to 4.2:1) which is well below the maximum draw ratio of approximately 20:1 which commonly would have been possible. Such maximum draw ratio is defined as that which would be possible by drawing the fiber in successive multiple draw stages (e.g., two stages). The level of drawing achieved will be influenced by the size of the holes of the spinnerette as well as the level of longitudinal tension. The drawing preferably is carried out in the filament-forming zone simultaneously with filament formation through the maintenance of longitudinal tension on the spinline. Alternatively, a portion of such drawing may be carried out in the filament-forming zone simultaneously with filament formation and a portion of the drawing may be carried out in one or more adjacent drawing zones.

The resulting as-spun acrylic multifilamentary material at the conclusion of such initial drawing commonly exhibits a denier per filament of approximately 3 to 40. When the fiber cross section is substantially circular, the denier per filament commonly is approximately 3 to 12. When the filament cross section is non-circular, the denier per filament commonly falls within the range of approximately 6 to 40. The as-spun acrylic multifilamentary material also is substantially void free when examined in cross section at a magnification 2,000×. Any voids which are observed in the as-spun acrylic fibers when a cross section is examined generally are less than 0.2 micron, and preferably less than 0.1 micron.

Minor concentrations of anti-coalescent and anti-static agents may optionally be applied to the multifilamentary material prior to its further processing. For instance, these may be applied from an aqueous emulsion which contains the same in a total concentration of approximately 0.5 percent by weight. Improved handling characteristics also may be imparted by such agents.

Next, the acrylic multifilamentary material is passed in the direction of its length through a heat treatment zone provided at a temperature of approximately 90° to 200° C. (preferably approximately 110° to 160° C.) while at a relatively constant length to accomplish the evolution of substantially all of the residual acetonitrile and water present therein, and the substantial collapse of any voids present in the fiber internal structure. While passing through the heat treatment zone the multifilamentary material may initially shrink slightly and subsequently be stretched slightly to achieve the overall substantially constant length. The overall shrinkage or stretching preferably should be kept to less than 5 percent while passing through the heat treatment zone and most preferably less than 3 percent (e.g., less than ±2 percent). The gaseous atmosphere present in the heat treatment zone preferably is substantially non-reactive with the acrylic multifilamentary material, and most preferably is air. In a preferred embodiment, the fibrous material comes in contact with the drums of a suction drum drier while present in the heat treatment zone. Alternatively, the fibrous material may come in contact with the surface of at least one heated roller. At the conclusion of this process step, the acrylic multifilamentary material preferably contains less than 2.0 percent by weight (most preferably less than 1.0 percent by weight) of acetonitrile and water based upon the polymer. At the conclusion of this process step, the acrylic multifilamentary material commonly contains 0.2 to less than 1.0 percent by weight of acetonitrile and water based upon the polymer.

The resulting acrylic multifilamentary material next is further drawn while at an elevated temperature at a draw ratio of at least 3:1 e.g., approximately 4 to 10:1) to form a multifilamentary material having a mean single filament denier of approximately 0.3 to 5.0 (e.g., 0.5 to 2.0). Such drawing preferably is carried out by applying longitudinal tension while the fibrous material is suspended in an atmosphere which contains steam. In a preferred embodiment, substantially saturated steam is provided at a superatmospheric pressure of approximately 10 to 30 psig while at a temperature of approximately 115° to 135° C. Also, in a preferred embodiment the acrylic multifilamentary material is conditioned immediately prior to such drawing by passage through an atmosphere containing hot water, steam (preferably substantially saturated steam), or mixtures thereof with no substantial change in the fiber length. Such conditioning has been found to render the fibers more readily amenable to undergo the final drawing in a highly uniform manner.

When the acrylic multifilamentary fibers possess a substantially circular cross section, a denier per filament following drawing of approximately 0.3 to 1.5 (e.g., approximately 0.5 to 1.2) preferably is exhibited. When the acrylic multifilamentary fibers possess a non-circular cross section, a denier per filament following drawing of approximately 0.5 to 5.0 (e.g., 0.7 to 3.0) commonly is exhibited. When fibers having a non-circular cross section are produced, the fibers following drawing commonly exhibit a configuration wherein the closest surface from all internal locations is less than 8 microns in distance (most preferably less than 6 microns in distance). In preferred embodiments cresecent-shaped and multi-lobed filaments comprise the acrylic multifilamentary material. In such preferred embodiments when cresecent-shaped acrylic filaments are formed, the greatest distance between internal points lying on a centerline connecting the two tips of the crescent and the nearest filament surface is less than 8 microns (most preferably less than 6 microns), and the length of the centerline generally is at least 4 times (most preferably at least 5 times) such greatest distance. In preferred embodiments when multi-lobed filaments having at least three lobes are formed (e.g. 3 to 6 lobes) the closest filament surface from all internal locations generally is less than 8 microns in distance (most preferably less than 6 microns in distance). With the multi-lobed acrylic fibers, the ratio of the total filament cross-sectional area to the filament core cross-sectional area preferably is greater than 1.67:1 (most preferably greater than 2.0:1) when the filament core cross-sectional area is defined as the area of the largest circle which can be inscribed within the perimeter of the filament cross section.

The resulting acrylic fibers preferably possess a mean single filament tensile strength of at least 5.0 grams per denier, and most preferably at least 6.0 grams per denier. The single filament tensile strength may be determined by use of a standard tensile tester and preferably is an average of at least 20 breaks. The resulting acrylic fibers lack the presence of a discrete skin/core or discrete outer sheath as commonly exhibited by some melt spun acrylic fibers of the prior art. Also, the acrylic multifilamentary material which results exhibits the requisite relatively low denier for carbon fiber production, the substantial absence of broken filaments and the concomitant surface fuzziness commonly associated with melt-spun acrylic multifilamentary materials of the prior art.

The acrylic multifilamentary material formed by the process of the present invention has been demonstrated to be particularly well suited for thermal conversion to form high quality fibers. Such thermal processing may be carried out by conventional routes heretofore used when acrylic fibers formed by solution processing have been transformed into carbon fibers. For instance, the fibers initially may be thermally stabilized by heating in an oxygen-containing atmosphere (e.g., air) at a temperature of approximately 200° to 300° C. or more. Subsequently, the fibers are heated in a non-oxidizing atmosphere (e.g., nitrogen) to a temperature of 1000° to 2000° C. or more to accomplish carbonization wherein the carbon fibers contain at least 90 percent carbon by weight. The resulting carbon fibers commonly contain at least 1.0 percent nitrogen by weight (e.g. at least 1.5 percent nitrogen by weight). As will be apparent to those skilled in the art, the lesser nitrogen concentrations generally are associated with higher thermal processing temperatures. The fibers optionally may be heated at even higher temperatures in a non-oxidizing atmosphere in order to accomplish graphitization.

The resulting carbon fibers commonly exhibit a mean denier per filament of approximately 0.2 to 3.0, (e.g., approximately 0.3 to 1.0). When carbon fibers having crescent-shaped cross sections are formed, the greatest distance between internal points lying on a centerline connecting the two tips of the crescent and the nearest surface preferably is less than 5 microns (most preferably less than 3.5 microns) and the centerline is preferably at least 4 times (most preferably at least 5 times) such greatest distance. When multi-lobed carbon fibers are formed of at least three lobes (e.g., 3 to 6 lobes), the closest filament surface from all internal locations in a preferred embodiment is less than 5 microns in distance and most preferably less than 3.5 microns in distance. Also, with such multi-lobed carbon fibers the ratio of the total filament cross-sectional area to the filament core cross-sectional area preferably is greater than 1.67:1 (most preferably greater than 2.0:1) when the filament core cross-sectional area is defined as the area of the largest circle which can be inscribed within the perimeter of the filament cross section. When the multi-lobed carbon fibers possess significantly pronounced lobes, the bending moment of inertia of the fibers is increased thereby enhancing the compressive strength of the fibers. In addition the present process makes possible the formation of quality carbon fibers which present relatively high surface areas for good bonding to a matrix material.

Alternatively, the acrylic multifilamentary material formed by the process of the present invention finds utility in the absence of thermal conversion to form carbon fibers. For instance, the resulting acrylic fibers may be used in textile or industrial applications which require quality acrylic fibers. Useful thermally stabilized or partially carbonized fibers which contain less than 90 percent carbon by weight also may be formed.

The carbonaceous fibrous material which results from the thermal stabilization and carbonization of the resulting acrylic multifilamentary material commonly exhibits an impregnated strand tensile strength of at least 300,000 psi (e.g., at least 400,000 psi). The substantially circular carbon fibers which result from the thermal processing of the substantially circular acrylic fibers preferably exhibit an impregnated strand tensile strength of at least 400,000 psi (most preferably at least 450,000 psi), and an impregnated strand tensile modulus of at least 10,000,000 psi (most preferably at least 30,000,000 psi). The substantially uniform non-circular carbon fibers of predetermined configuration which result from the thermal processing of the non-circular acrylic fibers preferably exhibit an impregnated strand tensile strength of at least 300,000 psi (most preferably at least 400,000 psi), and an impregnated strand tensile modulus of at least 10,000,000 psi (most preferably at least 30,000,000 psi), and a substantial lack of surface fuzziness indicating the substantial absence of broken filaments. The resulting carbon fibers are substantially void free when a cross section of the same is examined at a magnification of 2,000×. Any voids which are present upon the examination of the carbon fiber cross section commonly are less than 0.1 micron, and frequently are less than 0.05 micron.

The impregnated strand tensile strength and impregnated strand tensile modulus values reported herein are preferably average values obtained when six representative specimens are tested. During such test the resin composition used for strand impregnation typically comprises 1,000 grams of EPON 828 epoxy resin available from Shell Chemical Company, 900 grams of Nadic Methyl Anhydride available from Allied Chemical Company, 150 grams of Adeka EPU-6 epoxy available from Asahi Denka Kogyo Co., and 10 grams of benzyl dimethylamine. The multifilamentary strands are wound upon a rotatable drum bearing a layer of bleed cloth, and the resin composition is evenly applied to the exposed outer surface of the strands. Next, the outer surface of the resin-impregnated strands is covered with release paper and the drum bearing the strands is rotated for 30 minutes. The release paper next is removed and any excess resin is squeezed from the strands using bleeder cloth and a double roller. The strands next are removed from the drum, are wound onto polytetrafluoroethylene-coated flat glass plates, and are cured at 150° C. for two hours and 45 minutes. The strands are tested using a universal tester, such as an Instron 1122 tester equipped with a 1,000 lbs. load cell, pneumatic rubber faced grips, and a strain gauge extensometer using a 2 inch gauge length.

The tensile strength and tensile modulus values are calculated based upon the cross-sectional area of the strand in accordance with the following equations:

$$\text{(a) Tensile Strength (Ksi)} = \frac{F \times d \times 0.645}{W},$$

where:

$F$ = Breaking Load (lbs.)
$W$ = Yield without size (g./m.)
$d$ = Carbon Fiber Density (g./cm.$^3$)
0.645 = Units conversion.

$$\text{(b) Tensile Modulus (Msi)} = \frac{T \times d \times 0.000645}{W \times 0.005},$$

where:

$T$ = Tensile Load at 0.5% strain of extensometer (lbs.)
$W$ = Yield without size (g./m.)
$d$ = Carbon Fiber Density (g./cm.$^3$)
0.000645 = Units conversion.
0.005 = Strain (in./in.).

Composite articles may be formed which incorporate the carbon fibers as fibrous reinforcement. Representative matrices for such fibrous reinforcement include epoxy resins, bismaleimide resins, thermoplastic polymers, carbon, etc.

The following examples are presented as specific illustrations of the claimed invention with reference being made to the apparatus arrangement, fiber internal structures, and fiber cross sections illustrated in the drawings. It should be understood, however, that the invention is not limited to the specific details set forth in the examples.

EXAMPLE I

The acrylic polymer selected for use in the process of the present invention was formed by aqueous suspension polymerization and contained 93 weight percent of recurring acrylonitrile units, 5.5 weight percent of recurring methylacrylate units, and 1.5 weight percent of recurring methacrylic acid units. The acrylic polymer exhibited an intrinsic viscosity of approximately 1.4 to 1.5 and a kinematic viscosity (Mk) of approximately 55,000.

The resulting polymer slurry was dewatered to about 50 percent water by weight by use of a centrifuge, and 0.25 percent sodium stearate and 0.25 percent sorbitan monolaurate based on the dry weight of the polymer were blended with the polymer in a ribbon blender. The sodium stearate served a lubricating function and the sorbiton monolaurate served to aid in the dispersal of water throughout the polymer.

The resulting wet acrylic polymer cake was extruded through openings of ⅛ inch diameter to form pellets, and the resulting pellets were dried to a moisture content of approximately 2 percent by weight while placed on a belt and passed through an air oven provided at approximately 138° C. The resulting pellets next were sprayed with acetonitrile and water in appropriate quantities while being rotated in a V-shaped blender. The resulting pellets contained approximately 72.7 percent acrylic polymer by weight, approximately 13.9 percent acetonitrile by weight, and approximately 13.4 percent water by weight based upon the total weight of the composition. Based upon the weight of the polymer, the resulting pellets contained approximately 19.1 percent acetonitrile by weight, and approximately 18.4 percent water weight. The temperature of hydration and melting for the composition when determined as previously described is approximately 130° C.

Figure 1:
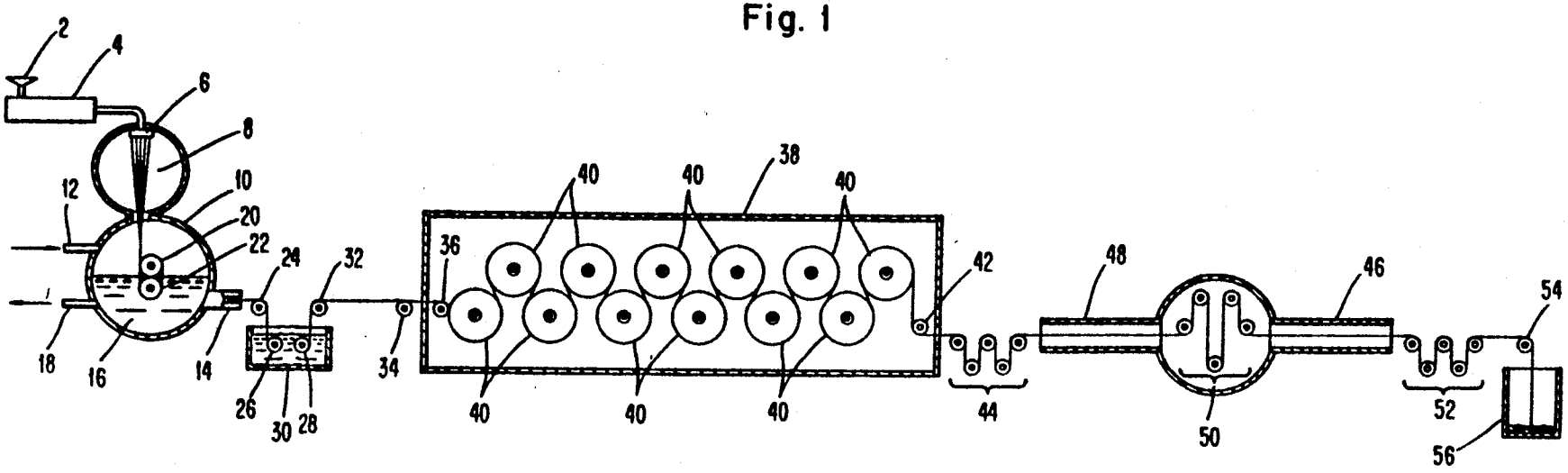
FIG. 1 is a schematic overall view of a preferred apparatus arrangement for forming an acrylic multifilamentary material in accordance with the present invention which is particularly suited for thermal conversion to quality carbon fibers.

With reference to FIG. 1, the pellets were fed from hopper 2 to a 1¼ inch single screw extruder 4 wherein the acrylic polymer was melted and mixed with the other components to form a substantially homogeneous polymer melt in admixture with the acetonitrile and water. The barrel temperature of the extruder in the first zone was 120° C., in the second zone was 166° C., and in the third zone was 174° C. The spinnerette 6 used in association with the extruder 4 contained 3021 circular holes of a 55 micron diameter and the substantially homogeneous melt was at 162° C. when it was extruded into a filament-forming zone 8 provided with an air purge having a temperature gradient of 80° to 130° C. The higher temperature within the gradient was adjacent to the face of the spinnerette. The air in the filament-forming zone 8 was provided at an elevated pressure of 20 psig.

The substantially homogeneous melt and the multifilamentary material were drawn in the filament-forming zone 8 at a relatively small draw ratio of approximately 1.8:1 once the melt left the face of the spinnerette 6. It should be noted that considerably more drawing (e.g., a total draw ratio of approximately 20:1) would have been possible had the product also been drawn in another draw stage; however, such additional drawing was not carried out in order to comply with the concept of overall process of the present invention.

Upon exiting from the filament-forming zone 8 the as-spun acrylic multifilamentary material was passed through a water seal 10 to which water was supplied at conduit 12. A labyrinth seal 14 was located towards the bottom of water seal 10. A water reservoir 16 was situated at the lower portion of water seal 10, and was controlled at the desired level through the operation of discharge conduit 18. The as-spun acrylic multifilamentary material was substantially free of filament breakage and passed in multiple passes around a pair of skewed rollers 20 and 22 which was located within water seal 10. A uniform tension was maintained on the spinline by the pair of skewed rolls 20 and 22 to achieve the specified relatively small draw ratio.

The resulting as-spun acrylic multifilamentary material possessed a denier per filament of approximately 9.1, exhibited an average filament diameter of approximately 11 microns, the absence of a discrete outer sheath, a substantially circular cross section, an internal structure which was substantially void free when examined in cross section at a magnification of 2,000×, and the substantial absence of internal voids greater than 0.2 micron when examined in cross section as described. See, FIG. 2 for a photographic illustration of a cross section of a representative substantially circular as-spun acrylic fiber which is typically obtained at this stage of the process.

The as-spun acrylic multifilamentary material passed over guide roller 24 and around rollers 26 and 28 situated in vessel 30 which contained silicone oil in water in a concentration of 0.4 percent by weight based upon the total weight of the emulsion prior to passage over guide rollers 32 and 34. The silicone oil served as an anticoalescent agent and improved fiber handleability during the subsequent steps of the process. A polyethylene glycol antistatic agent having a molecular weight of 400 in a concentration of 0.1 percent by weight based upon the total weight of the emulsion also was present in vessel 30.

Next, the acrylic multifilamentary material was passed in the direction of its length over guide roller 36 and through a heat treatment oven 38 provided with circulating air at 150° C. where it contacted the surfaces of rotating drums 40 of a suction drum dryer. The air was introduced into heat treatment oven 38 at locations along the top and bottom of such zone and was withdrawn through perforations on the surfaces of drums 40. While passing through the heat treatment oven 38 at a relatively constant length, substantially all of the acetonitrile and water present therein was evolved and any voids originally present therein were substantially collapsed. The acrylic fibrous material immediately prior to withdrawal from the heat treatment oven 38 passed over guide roller 42. The desired tension was maintained on the acrylic multifilamentary material as it passed through heat treatment oven 38 by a cluster of tensioning rollers 44. The resulting acrylic multifilamentary material contained less than one percent by weight of acetonitrile and water based upon the weight of the polymer. When examined under a scanning electron microscope, as illustrated in FIG. 3, it is found that there typically is an overall further reduction in the size of the voids present in the as-spun acrylic fiber prior to the heat treatment step.

The acrylic multifilamentary material following passage through heat treatment oven 38 was stretched at a draw ratio of 8.7:1 in drawing zone 46 containing a saturated steam atmosphere provided at 18 psig and approximately 124° C. Immediately prior to such stretching the fibrous material was passed while at a substantially constant length through an atmosphere containing saturated steam at the same pressure and temperature present in conditioning zone 48 in order to pretreat the same. The appropriate tensions were maintained in conditioning zone 48 and drawing zone 46 by the adjustment of the relative speeds of clusters of tensioning rollers 44, 50, and 52. Following such drawing the acrylic multifilamentary material passed over guide roller 54 and was collected in container 56 by piddling. The product exhibited a denier per filament of approximately 1.05, was particularly well suited for thermal conversion to high strength carbon fibers, and possessed a mean single filament tensile strength of approximately 5 to 6 grams per denier. The resulting acrylic fibers lacked the presence of a discrete skin/core or discrete outer sheath as commonly exhibited by melt spun acrylic fibers of the prior art. Also, there was a substantial absence of broken filaments within the resulting fibrous tow as evidenced by a lack of surface fuzziness.

The acrylic multifilamentary material was thermally stabilized by passage through an air oven for a period of approximately 50 minutes during which time the fibrous material was subjected to progressively increasing temperatures ranging from approximately 240° to 260° C. during which processing the fibrous material shrank in length approximately 5 percent. The density of the resulting thermally stabilized fibrous material was approximately 1.29 to 1.31 grams/cm.$^3$.

The thermally stabilized acrylic multifilamentary material next was carbonized by passage in the direction of its length while at a substantially constant length through a nitrogen-containing atmosphere provided at a maximum temperature of approximately 1350° C., and subsequently was electrolytically surface treated in order to improve its adhesion to a matrix-forming material. The carbon fibers contained in excess of 90 percent carbon by weight and approximately 4.5 percent nitrogen by weight. See FIG. 4 for a photographic illustration of a representative substantially circular carbon fiber formed by the thermal processing of a representative substantially circular acrylic fiber of the present invention. When a representative fiber cross section is examined under a scanning electron microscope at a magnification of 2,000×, it is found that no voids are apparent. When examined under a scanning electron microscope at a magnification of 12,000×, it is found that some very small voids are visible. These small voids generally are less than 0.1 micron in size. The resulting carbon fibers exhibited a substantially circular cross section and exhibited an impregnated strand tensile strength of approximately 519,000 psi, an impregnated strand tensile modulus of approximately 33,800,000 psi, and an elongation of approximately 1.54 percent. The product weighed approximately 0.149 gram/meter, possessed a mean denier per filament of approximately 0.45, exhibited an average filament diameter of approximately 6 microns, and possessed a density of approximately 1.78 gram/cm.$^3$. There was a substantial absence of broken filaments within the resulting carbon fiber product as evidenced by a lack of surface fuzziness.

Composite articles exhibiting good mechanical properties may be formed wherein the carbon fibers serve as fibrous reinforcement.

For comparative purposes if the process of Example I is repeated with the exception that the intermediate heat treatment step is omitted or all of the drawing is conducted prior to substantially complete acetonitrile and water removal, a markedly inferior product is produced which is not well suited for carbon fiber production. Also, markedly inferior results are achieved when the acetonitrile is omitted from the substantially homogeneous melt at the time of extrusion.

The above Example I demonstrates that the process of the present invention provides a reliable melt-spinning process to produce acrylic fibers which are particularly well suited for thermal conversion to quality carbon fibers. Such resulting carbon fibers can be used in those applications in which carbon fibers derived from solution-spun acrylic fibers previously have been utilized. One is now able to carry out the carbon fiber precursor-forming process in a simplified manner. Also, one can now eliminate the utilization and handling of large amounts of solvent as has been necessary in the prior art.

EXAMPLE II

Example I was substantially repeated while using a spinnerette 6 having trilobal openings to form filaments having trilobal cross sections.

The pellets prior to melting contained approximately 17.0 percent acetonitrile by weight, and approximately 18.3 percent water by weight based upon the polymer. The temperature of hydration and melting for the composition when determined as previously described is approximately 125° C.

The spinnerette contained Y-shaped or trilobal extrusion orifices numbering 1596 wherein each lobe was 50 microns in length and 30 microns in width with each lobe being equidistantly spaced at 120 degree centers. The capillary length decreased from the center to the end of each lobe.

The barrel temperature of the extruder in the first zone was 120° C., in the second zone was 165° C., and in the third zone was 175° C., and the melt was at 159° C. when it was extruded into filament-forming zone 8 containing air at 40 psig.

The resulting as-spun acrylic multifilamentary material having trilobal filament cross sections immediately prior to heat treatment possessed a denier per filament of approximately 17.6. The acrylic trilobal multifilamentary material following passage through the heat treatment oven 38 was stretched at a draw ratio of 10.7:1. The acrylic product exhibited a denier per filament of approximately 1.65, was particularly well suited for thermal conversion to high strength carbon fibers, and possessed a mean single filament tensile strength of approximately 5 to 6 grams per denier. The closest filament surface from all internal locations within the acrylic filaments was no more than approximately 5 microns.

Figure 5:
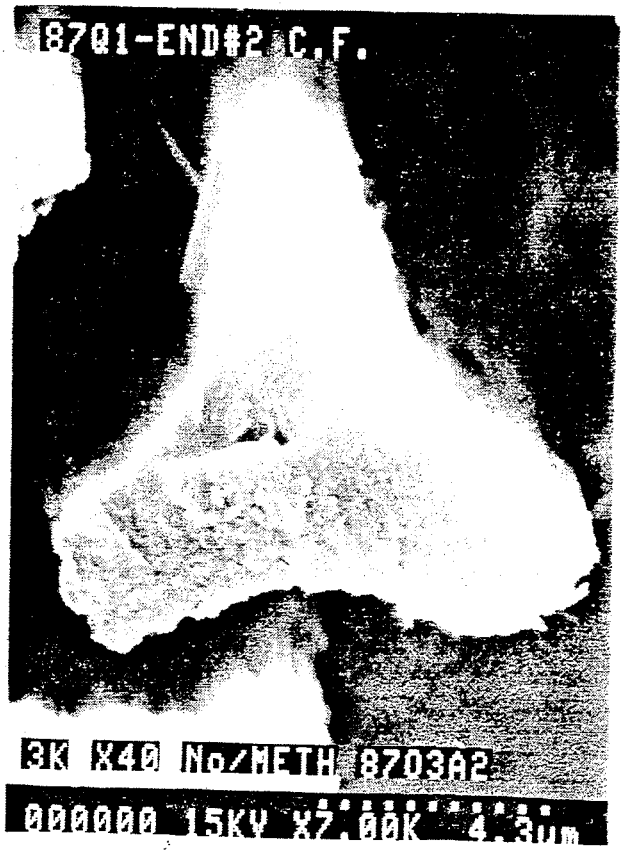
FIG. 5 is a photograph of a cross section of a representative non-circular carbon fiber formed by the thermal processing of a representative trilobal acrylic fiber formed in accordance with the process of the present invention at a magnification of 7,000× obtained by the use of a scanning electron microscope.

The trilobal acrylic multifilamentary material was thermally stabilized by passage through an air oven for a period of approximately 55 minutes during which time the fibrous material was subjected to progressively increasing temperatures ranging from 243° to 260° C. Carbonization was conducted at approximately 1350° C. The resulting carbon fibers contained in excess of 90 percent carbon by weight and approximately 4.5 percent nitrogen by weight. FIG. 5 illustrates a representative cross section of a trilobal carbon fiber formed in accordance with the process of the present invention. The closest filament surface from all internal locations within the carbon filaments was no more than approximately 3 microns. The ratio of the total filament cross-sectional area to the filament core cross-sectional area is 2.42:1 when the filament core cross-sectional area is defined as the area of the largest circle which can be inscribed within the perimeter of the filament cross section.

The resulting trilobal carbon fibers exhibited a denier per filament of approximately 0.81, an impregnated strand tensile strength of approximately 332,000 psi, an impregnated strand tensile modulus of approximately 31,600,000 psi, an elongation of 1.05, and possessed a density of approximately 1.75 gram/cm.$^3$. There was a substantial absence of broken filaments within the resulting carbon fiber product as evidenced by a lack of surface fuzziness. Composite articles exhibiting good mechanical properties may be formed wherein the trilobal carbon fibers serve as fibrous reinforcement.

Although the invention has been described with preferred embodiments, it is to be understood that variations and modifications may be employed without departing from the concept of the invention as defined in the following claims.

We claim:

1. A melt-spun acrylic multifilamentary material possessing a highly uniform internal structure which is particularly suited for thermal conversion to quality carbon fibers formed by the process comprising:

(a) forming at an elevated temperature a substantially homogeneous melt consisting essentially of (i) an acrylic polymer containing at least 85 weight percent of recurring acrylonitrile units, (ii) approximately 11 to 25 percent by weight of acetonitrile based upon said polymer, and (iii) approximately 12 to 28 percent by weight of water based upon said polymer, (b) extruding said substantially homogeneous melt while at a temperature within the range of 140° to 190° C. which exceeds the hydration and melting temperature by at least 15° C. through an extrusion orifice containing a plurality of openings into a filament-forming zone provided with a substantially non-reactive gaseous atmosphere provided at a temperature within the range of approximately 25° to 250° C. while under a longitudinal tension wherein substantial portions of said acetonitrile and water are evolved and an acrylic multifilamentary material is formed, (c) drawing said substantially homogeneous melt and acrylic multifilamentary material subsequent to passage through said extrusion orifice at a draw ratio of approximately 0.6 to 6.0:1, (d) passing said resulting acrylic multifilamentary material following steps (b) and (c) in the direction of its length through a heat treatment zone provided at a temperature of approximately 90° to 200° C. while at a relatively constant length wherein the evolution of substantially all of the residual acetonitrile and water present therein takes place, and (e) drawing said acrylic multifilamentary material resulting from step (d) while at an elevated temperature at a draw ratio of at least 3:1 to form an acrylic multifilamentary material having a mean single filament denier of approximately 0.3 to 5.0, wherein said resulting melt-spun acrylic multifilamentary material comprises approximately 500 to 50,000 substantially continuous filaments which lack the presence of a discrete outer sheath when examined in cross section having a means single filament denier of approximately 0.3 to 5.0, and a means single filament tensile strength of at least 5.0 grams per denier.

2. A melt-spun acrylic multifilamentary material possessing a highly uniform internal structure which is particularly suited for thermal conversion to quality carbon fibers according to claim 1 comprising substantially uniform filaments having crescent-shaped cross sections wherein the greatest distance between internal points lying on a centerline connecting the two tips of the crescent and the nearest filament surface generally is less than 8 microns and the length of the centerline generally is at least 4 times such greatest distance.

3. A melt-spun acrylic multifilamentary material possessing a highly uniform internal structure which is particularly suited for thermal conversion to quality carbon fibers according to claim 1 comprising substantially uniform filaments having multi-lobed cross sections of at least 3 lobes wherein the closest filament surface from all internal locations is less than 8 microns in distance, and the ratio of the total filament cross-sectional area to the filament core cross-sectional area is greater than 1.67:1 when the filament core cross-sectional area is defined as the area of the largest circle which can be inscribed within the perimeter of the filament cross section.

4. A melt-spun acrylic multifilamentary material possessing a highly uniform internal structure which is particularly suited for thermal conversion to quality carbon fibers according to claim 1 comprising substantially uniform filaments having predetermined substantially uniform non-circular cross-sections.

5. A multifilamentary carbonaceous fibrous material formed by the thermal stabilization and carbonization of the acrylic multifilamentary material possessing a highly uniform internal structure which is particularly suited for thermal conversion to quality carbon fibers according to claim 1 wherein said multifilamentary carbonaceous fibrous material following said thermal stabilization and carbonization contains at least 90 percent carbon by weight, exhibits a means denier per filament of approximately 0.2 to 3.0, and exhibits an impregnated strand tensile strength of at least 300,000 psi.

6. A multifilamentary carbonaceous fibrous material formed by the thermal stabilization and carbonization of the acrylic multifilamentary material possessing a highly uniform internal structure which is particularly suited for thermal conversion to high strength carbon fibers according to claim 1 wherein said multifilamentary carbonaceous fibrous material following said thermal stabilization and carbonization comprises filaments having predetermined substantially uniform non-circular cross-section, and contains at least 90 percent carbon by weight.

7. A multifilamentary carbonaceous fibrous material formed by the thermal stabilization and carbonization of the acrylic multifilamentary material possessing a highly uniform internal structure which is particularly suited for thermal conversion to high strength carbon fibers according to claim 1 wherein said multifilamentary carbonaceous fibrous material following said thermal stabilization and carbonization comprises substantially uniform filaments having crescent-shaped cross sections wherein the greatest distance between internal points lying on a centerline connecting the two tips of the crescent and the nearest filament surface generally is at least 4 times such greatest distance.

8. A multifilamentary carbonaceous fibrous material formed by the thermal stabilization and carbonization of the acrylic multifilamentary material possessing a highly uniform internal structure which is particularly suited for thermal conversion to high strength carbon fibers according to claim 1 wherein said multifilamentary carbonaceous fibrous material following said thermal stabilization and carbonization comprises substantially uniform filaments having multi-lobed cross sections of at least 3 lobes wherein the closest filament surface from all internal locations is less than 5 microns in distance, and the ratio of the total filament cross-sectional area to the filament core cross-sectional area is greater than 1.67:1 when the filament core cross-sectional area is defined as the area of the largest circle which can be inscribed within the perimeter of the filament cross section.

9. A melt-spun acrylic multifilamentary material possessing a highly uniform internal structure which is particularly suited for thermal conversion to quality carbon fibers formed according to the process comprising:

(a) forming at an elevated temperature a substantially homogeneous melt consisting essentially of (i) an acrylic polymer containing at least 91 weight percent of recurring acrylonitrile units, (ii) approximately 14 to 21 percent by weight of acetonitrile based upon said polymer, and (iii) approximately 15 to 23 percent by weight of water based upon said polymer, with the proviso that the said acrylic polymer is present in a concentration of approximately 72 to 80 percent by weight based upon the total weight of the melt, (b) extruding said substantially homogeneous melt while at a temperature within the range of 155° to 185° C. which exceeds the hydration and melting temperature by at least 20° C. through an extrusion orifice containing a plurality of openings into a filament-forming zone provided with a substantially non-reactive gaseous atmosphere at a pressure of approximately 10 to 50 psig provided at a temperature within the range of approximately 90° to 200° C. while under a longitudinal tension wherein substantial portions of said acetonitrile and water are evolved and an acrylic multifilamentary material is formed, (c) drawing said substantially homogeneous melt and acrylic multifilamentary material subsequent to passage through said extrusion orifice at a draw ratio of approximately 0.8 to 5.0:1, (d) passing said resulting acrylic multifilamentary material following steps (b) and (c) in the direction of its length through a heat treatment zone provided at a temperature of approximately 110° to 175° C. while at a relatively constant length wherein the evolution of substantially all of the residual acetonitrile and water present therein takes place, and (e) drawing said acrylic multifilamentary material resulting from step (d) while at an elevated temperature at a draw ratio of approximately 4 to 10:1 to form an acrylic multifilamentary material having a means single filament denier of approximately 0.3 to 5.0, wherein said resulting melt-spun acrylic multifilamentary material comprises approximately 500 to 50,000 substantially continuous filaments which lack the presence of a discrete outer sheath when examined in cross section having a means single filament denier of approximately 0.5 to 2.0, and a means single filament tensile strength of at least 5.0 grams per denier.

10. A melt-spun acrylic multifilamentary material possessing a highly uniform internal structure which is particularly suited for thermal conversion to quality carbon fibers according to claim 9 comprising substantially uniform filaments having crescent-shaped cross sections wherein the greatest distance between internal points lying on a centerline connecting the two tips of the crescent and the nearest filament surface generally is less than 6 microns and the length of the centerline is at least 5 times such greatest distance.

11. A melt-spun acrylic multifilamentary material possessing a highly uniform internal structure which is particularly suited for thermal conversion to quality carbon fibers according to claim 9 comprising substantially uniform filaments having multi-lobed cross sections of 3 to 6 lobes wherein the closest filament surface from all internal locations is less than 6 microns in distance and the ratio of the total filament cross-sectional area to the filament core cross-sectional area is greater than 2:1 when the filament core cross-sectional area is defined as the area of the largest circle which can be inscribed within the perimeter of the filament cross-section.

12. A melt-spun acrylic multifilamentary material possessing a highly uniform internal structure which is particularly suited for thermal conversion to quality carbon fibers according to claim 9 comprising substantially uniform filaments having predetermined substantially uniform non-circular cross-sections.

13. A multifilamentary carbonaceous fibrous material formed by the thermal stabilization and carbonization of the acrylic multifilamentary material according to claim 9 wherein said multifilamentary carbonaceous fibrous material following said thermal stabilization and carbonization contains at least 90 percent carbon by weight, exhibits a mean denier per filament of approximately 0.2 to 3.0, and exhibits an impregnated strand tensile strength of at least 300,000 psi.

14. A multifilamentary carbonaceous fibrous material formed by the thermal stabilization and carbonization of the acrylic multifilamentary material possessing a highly uniform internal structure according to claim 9 wherein said multifilamentary carbonaceous fibrous material following said thermal stabilization and carbonization contains at least 90 percent carbon by weight, exhibits a mean denier per filament of approximately 0.3 to 1.0, and exhibits an impregnated strand tensile strength of at least 400,000 psi.

15. A multifilamentary carbonaceous fibrous material formed by the thermal stabilization and carbonization of the acrylic multifilamentary material possessing a highly uniform internal structure which is particularly suited for thermal conversion to quality carbon fibers according to claim 9 wherein said multifilamentary carbonaceous fibrous material following said thermal stabilization and carbonization comprises filaments having predetermined substantially uniform non-circular cross sections, and contains at least 90 percent carbon by weight.

16. A multifilamentary carbonaceous fibrous material formed by the thermal stabilization and carbonization of the acrylic multifilamentary material possessing a highly uniform internal structure which is particularly suited for thermal conversion to quality carbon fibers according to claim 9 wherein said multifilamentary carbonaceous fibrous material following said thermal stabilization and carbonization comprises substantially uniform filaments having crescent-shaped cross sections wherein the greatest distance between internal points lying on a centerline connecting the two tips of the crescent and the nearest filament surface generally is less that 3.5 microns and the centerline generally is at least 5 times such greatest distance.

17. A multifilamentary carbonaceous fibrous material formed by the thermal stabilization and carbonization of the acrylic multifilamentary material possessing a highly uniform internal structure which is particularly suited for thermal conversion to high strength carbon fibers according to claim 9 wherein said multifilamentary carbonaceous fibrous material following said thermal stabilization and carbonization comprises substantially uniform filaments having multi-lobed cross section of 3 to 6 lobes wherein the closest filament surface from all internal locations is less that 3.5 microns in distance, and the ratio of the total filament cross-sectional area to other filament core cross-sectional area is greater than 2:1 when the filament core cross-sectional area is defined as the area of the largest circle which can be inscribed within the perimeter of the filament cross section.

* * * * *